US007194810B2

(12) United States Patent
Shai

(10) Patent No.: US 7,194,810 B2
(45) Date of Patent: Mar. 27, 2007

(54) TILE EDGE MARKER AND CUTTER

(76) Inventor: Moti Shai, 3524 Via del Prada, Calabasas, CA (US) 91302

( * ) Notice: Subject to any disclaimer, the term of this patent is extended or adjusted under 35 U.S.C. 154(b) by 20 days.

(21) Appl. No.: 10/975,116

(22) Filed: Jan. 31, 2005

(65) Prior Publication Data

US 2006/0168826 A1 Aug. 3, 2006

(51) Int. Cl.
*B43L 13/02* (2006.01)

(52) U.S. Cl. ..... 33/42; 33/526

(58) Field of Classification Search ..... 33/42, 33/1 K, 41.1, 41.3, 41.5, 41.6, 43, 526, 527
See application file for complete search history.

(56) References Cited

U.S. PATENT DOCUMENTS 1,662,165 A * 3/1928 Punt ..... 33/41.5
1,792,393 A * 2/1931 Phillips ..... 33/42
2,409,106 A * 10/1946 Connelly ..... 33/41.5
2,430,349 A * 11/1947 Lefebvre ..... 33/42
4,334,360 A * 6/1982 Burns et al. ..... 33/42
4,934,058 A * 6/1990 Gibson ..... 33/42
5,862,601 A * 1/1999 O'Brien et al. ..... 33/42

* cited by examiner

*Primary Examiner*—Christopher W. Fulton

(57) ABSTRACT

A device and method for marking or scratching a ceramic tile, to be laid adjacent to a boundary surface is presented. This tile is subsequently cut according to the mark generated by the device. In the first embodiment, said tile is placed upside down between a backup member and an etching member of the apparatus, both connected to a support member resembling a clamp. Said members place pressure on the said edge tile, while said tile is held in place with one hand of the user. The tile is consequently etched when the device is slid across the tile, and along the edge of an adjacent laid tile via a sliding means be constructed to engage the surface below the laid tiles. In the second embodiment, the apparatus resembles a marker with an angled marking point. On one end an adjustable guide wheel is attached and optionally, on the opposite end, a sliding means is attached. It operates in principle as the first embodiment.

12 Claims, 2 Drawing Sheets

TILE EDGE MARKER AND CUTTER

BACKGROUND OF THE INVENTION

1. Field of the Invention

The present invention relates generally to devices used for marking and cutting tiles that are resized to fit large boundary areas occurring on floors walls and counter tops.

2. Description of the Related Art

Individuals installing tiles on a surface such as a floor are regularly challenged with the cutting of particular tiles to conform to a space between the penultimate rows of tiles and a boundary surface where the particular tile (herein referred to as "edge tile") needs to be installed. The commonly accepted method used for preparing such tiles consists of two steps: First, manual measurements are taken of the dimensions of the surface where the tile is to be installed. Second, the measurements are transferred onto a conventional tile, which is then cut. The time required for taking and transferring these measurement onto the tile is usually considerably long, and is a major drawback of this method.

A variety of systems and methods have been developed over the years for marking and cutting edge tiles, but usually these systems are big in size and complex in their usage. More importantly, none of the devices available today are hand-held and specifically designed for etching ceramic files. Etching of ceramic tiles is desirable considering that the etch markings can serve as the line of fracture of the tile when the tile is broken. The only invention that utilizes an etching means is the patent to M. Crain (U.S. Pat. No. 2,619,173), which describes a device that is bulky, relatively expensive to manufacture and not suited for operating with one hand. Furthermore, it is complicated in usage, limited to areas larger than the width of the device and requires re-tightening of the knobs with each new tile. As with the patent to R. Julien (U.S. Pat. No. 6,305,090), the device components must cooperate in a complex manner to adjust for moving along a slanted wall thus rendering the device susceptible to imprecision due to friction at many junctions in the device. Furthermore, this device is only capable of marking a tile, rather than etching it. Similarly the J. Di Candilo patent (U.S. Pat. No. 3,548,505) is limited not only to marking but also to the size of plates used, since each size of file requires another sized plate.

Many devices previously invented are only capable of acquiring a measurement, which is to be transferred onto the tile in a separate step. Examples of such devices are the D. Armstrong patent (U.S. Pat. No. 5,038,490) and the Le Moal patent (U.S. Pat. No. 4,827,625). Other inventions such as the D. Squires patent (U.S. Pat. No. 4,646,439) are not designed for ceramic tiles and the blade moves during cutting rather than the whole device. Furthermore, the blade can only cut from the top of the tile and thus cannot be applied to ceramic tiles. This is due to the fact that ceramic tiles must be bottom side up when markings are made to correctly match the boundary surface after cutting. For the reasons mentioned above existing devices in today's market are neither efficient nor practical and are rarely used by a present-day professional tile-man.

The system and the methods of the present invention are particularly useful for enabling efficient and practical tile markings. In the first embodiment previously discussed, the present invention is similar to conventional pliers in size and weight. This invention is practical and timesaving since it does not require any assembly and it is safely used by one hand to etch and mark a tile, to a precise measurement in a convenient manner. Furthermore, the current invention can be used for different tile sizes and it is adjustable to provide different ground space between the edge tiles and other adjacent tiles.

In the second embodiment, this invention is a pocket sized, lightweight device resembling a pen and can be used by one hand to provide the same results as complex devices exist today on the market. Practicality and efficiency of this device is derived from fact that the tile is flipped upside down and the actual marking is done on the bottom side for a perfect match. The method of flipping the tile upside down and marking it is exclusively used by this invention.

Therefore, the present invention provides a highly effective means for providing a simpler, more efficient and very practical, procedure for edge tile marking (and subsequent cutting) without sacrificing any precision, accuracy or safety. The inventions disclosed herein satisfy these and other needs. Still further objects and advantages of this invention will become apparent from a consideration of the drawings and ensuing description.

DETAILED DESCRIPTION OF THE PREFERRED EMBODIMENT

The present invention provides a new and improved system and method for providing a user with a practical and efficient way to accurately and precisely mark and scratch edge tile.

Figure 1:
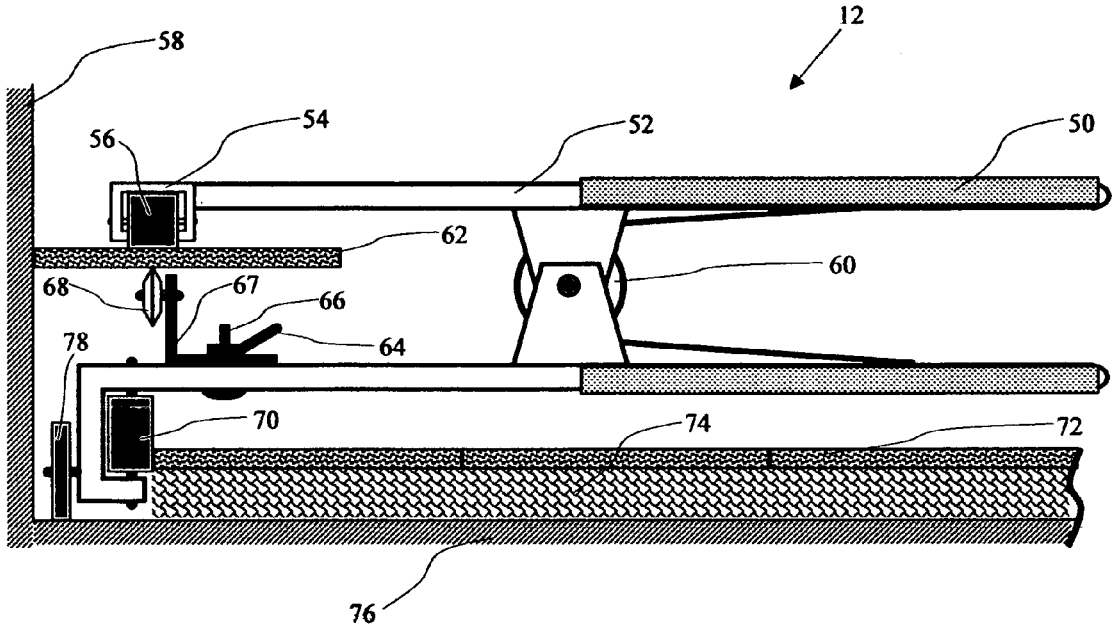
FIG. 1 is a front view of the first embodiment—the tile edge cutter.
Figure 2:
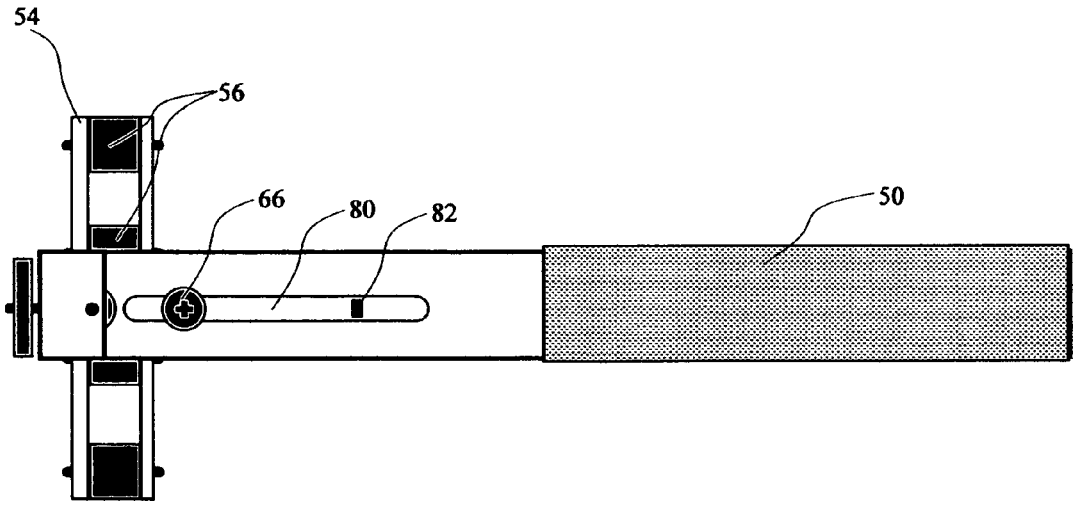
FIG. 2 is a view from the bottom of the first embodiment, clearly showing scratchier adjuster groove and groove guide.
Figure 5:
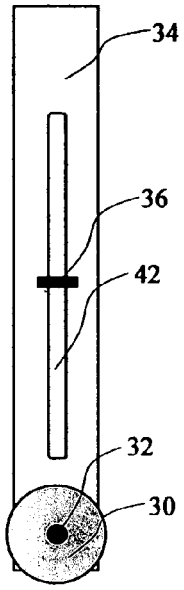
FIG. 5 is a view from the bottom of the adjustable arm, which is part of the second embodiment, clearly showing adjustable arm groove and adjustable arm lock.
Figure 3:
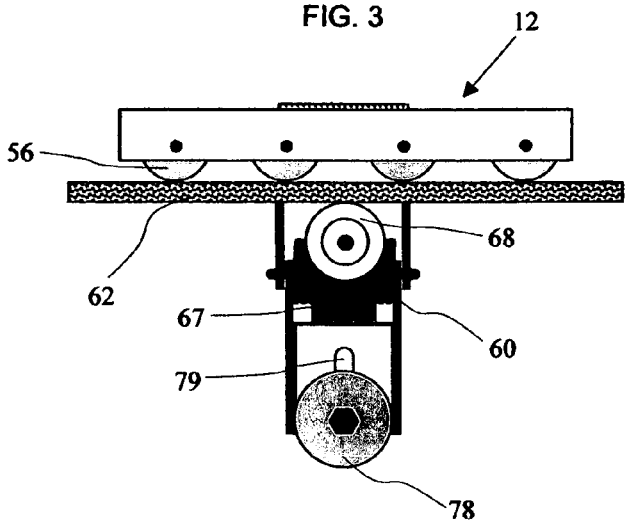
FIG. 3 is a side view of the first embodiment.

More particularly, in a first embodiment FIGS. 1, 2 and 3, the user holds the uncut tile 62 upside down tight to the adjacent wall 58 in his other hand he holds the scratching device 12 by rubber handle 50 while the device is positioned on and against the laid tile 72 which is laid on a cement surface 74. The uncut tile is tightly placed inside the device between the cutting means 68 and the guiding wheels 56 which are held in place by a "u"-shaped track 54, and then the user slides the device along the tile to scratch it to precise measurement. The spring 60 puts pressure on the tile wheels 56 and the uncut tile 62, making the cutting easier. The scratchier wheel 68 can be adjusted by the releasing the adjustment knob 64 from the adjuster lock screw 66 thereby allowing the scratchier adjuster 67 to move along the scratchier adjuster groove 80, which is secured by the groove guide 82. The entire device slides along the surface 76 the by the sliding wheel 78 and at the same along the laid tile 72 with the guide wheel 70.

A second embodiment of the current invention is a pocket sized and very light edge tile marker. The tile marker is comfortably used by one hand while the user holds the uncut tile upside down tight to the adjacent wall in his other hand he holds the marker device which is positioned against the laid tile. The user slides the marking device along the tile generating accurate mark on the tile which is parallel to the wall. Practicality and efficiency of that device derived from fact that the tile is flipped upside down and the actual marking is done on the bottom side for perfect match. The method of flipping the tile upside down and marking it is exclusively developed and used by this embodiment of the current invention. Marking device can be adjusted for different ground space between the tiles.

*Other objects, advantages and features of the present invention will become more apparent upon reading of the following non-restrictive description of preferred embodiments thereof, given by the way of example only with reference to the accompanying drawings.

Figure 4:
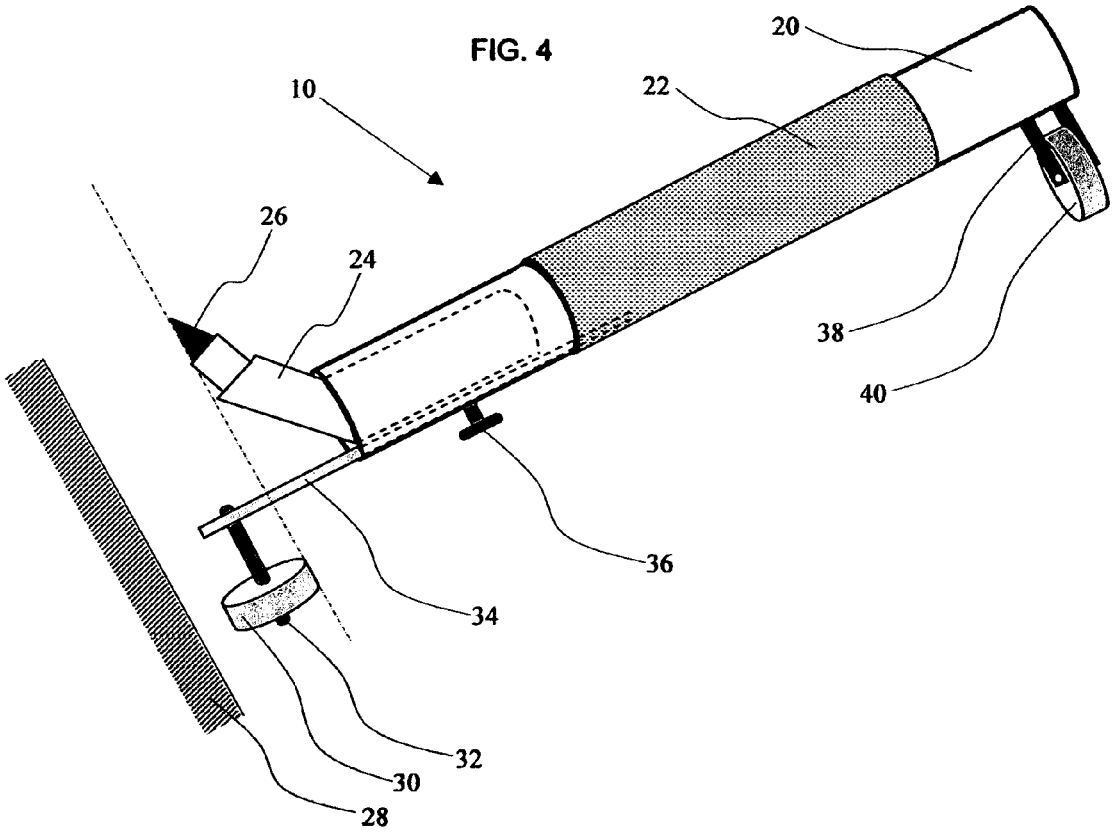
FIG. 4 is a perspective view of the second embodiment—the tile edge marker.

As illustrated in FIG. 4, in a preferred second embodiment in accordance with the present invention, for example, the system 10 comprises a body 20 attached to a gripping means, preferably rubber. On one end of the body a wheel 40 is attached at 90 degrees to the body with a wheel holder 38, such that that the axis of the wheel is parallel to the body. On the other end, a marker 26 is attached to the end of a bent arm 24 which is attached to the inside of the body 20. On the same end, an adjustable arm 34 attached internally to the body and along the same line as the body. A guide wheel 30 is attached at 90 degrees to the adjustable arm 34 horizontally. The adjustable arm can be moved in or out of the body by releasing the adjustable arm lock 36 allowing the arm lock it to move along the adjustable arm groove 42.

The invention claimed is:

1. A device for etching the face surface of an edge tile having a face and a bottom surface, according to an area between a penultimate row of laid tiles and an adjacent boundary surface, such that said edge tile is subsequently cut according to etch markings to be fitted to said area comprising:

a first sliding means for supporting and facilitating movement along said bottom surface of the edge tile while said edge tile is positioned bottom surface up as the devices moves across said edge tile;

a etching member engaging said face surface of said edge tile;

a guiding member for engaging the edge of an adjacent laid tile as the device traverses said edge tile, to enable the marking of a straight line; and a support member attached to said guiding member and that supports said etching member against said face surface of said edge tile and also supports a second and third sliding means against said bottom surface of said edge tile.

2. The device of claim 1 wherein said support is comprised of a top and bottom elongated lever members each having a rearward portion and a forward portion, said rearward portions forming handles that can be manually pressed towards each other, said lever members pivotally coupled at an approximately central portion between said rearward and forward portions of each said lever members, said etching member adjustably connected means to said forward portion of said bottom lever member, said first sliding means positioned on said front portion of said upper lever member to engage said edge tile, said guiding member located on said front portion of said bottom lever member engaging the edge of an adjacent laid tile as the device traverses said edge tile.

3. The device of claim 2 comprising an urging means situated between said lever members urging said forward portions towards one another thereby placing pressure on said edge tile positioned between said lever members.

4. The device of claim 3 wherein said urging means is a spring.

5. The device of claim 2 including a second sliding means attached to said front portion of said bottom lever member such that said second sliding means engages the surface below laid tiles as the device moves across said edge tile.

6. The device of claim 5 wherein said second sliding means is a wheel.

7. The device of claim 2 wherein said etching member is a circular rotating blade.

8. A device for marking the face surface of an edge tile, having a face surface and a bottom surface, said edge tile to be cut according to the markings generated by moving said device across said edge tile, comprising:

a elongated body member having a head portion, a tail portion, an internal cavity, and a central axis to the body, where a wheel holder is attached to said tail portion, a bent arm adjustably attached to said internal cavity extending out from said internal cavity at said head portion at an angle between 0 to 90 degrees to said central axis;

a marking means attached to said bent arm at an angle such that the sum of the angle created by said bent arm and marker creates an approximately 90 degree angle with respect to said central axis thereby allowing marking said face surface of said edge tile;

an adjustable arm extending out from said internal cavity at the end of said head portion; and a guide wheel attached to said adjustable arm at approximately 90 degrees to said central axis that can engage the edge of said laid tiles.

9. The device of claim 8 comprising a sliding means fixed to the end of said tail portion that can communicate with the laid tiles as said device traverses an edge tile.

10. The device of claim 8 comprising: an adjustable arm lock, allowing adjustment of said adjustable arm and said bent arm, according to a desired interstitial space between said edge tile and an adjacent laid tile, when released and locking together both said adjustable arm and bent arm when locked.

11. The device of claim 8 wherein said marking means has color.

12. A method for marking edge tiles according to the contours of an adjacent boundary surface to be fitted with said edge tiles which are subsequently cut according to the etch markings comprising the steps of:

positioning a tile to be laid such that the front side of the tile is facing down;

placing and holding the edge of said tile to the boundary edge surface at a practical distance above where the tile is to be installed;

etching the face surface an edge tile having a face and a bottom surface, including a etching member for engaging said face surface of said edge tile, a guiding member for engaging the edge of an adjacent laid tile as the device traverses said edge tile, a support member, including a top and bottom elongated lever members each having a rearward portion and a forward portion, said rearward portions forming handles that can be manually pressed towards each other, said lever members pivotally coupled at an approximately central portion, attached to said guiding member and that supports said etching member against said face surface of said edge tile and also supports, a second and third sliding means against said bottom surface of said edge tile;

facilitating movement along said face surface of edge tile while said tile is positioned bottom surface up as the devices moves across said edge tile; and engaging a second sliding means attached to said front portion to said bottom lever member such that said second sliding means engages the surface below laid tiles as the device moves across said edge tile.

* * * * *